US006350024B2

(12) United States Patent
Haines

(10) Patent No.: US 6,350,024 B2
(45) Date of Patent: Feb. 26, 2002

(54) DIAPHRAGM PUMP HAVING AN INTEGRAL PRESSURE PLATE

(75) Inventor: Paul Mark Haines, Lebanon, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/826,645

(22) Filed: Apr. 5, 2001

Related U.S. Application Data

(62) Division of application No. 09/012,384, filed on Jan. 23, 1998.

(51) Int. Cl.[7] ..... B41J 2/175
(52) U.S. Cl. ..... 347/85
(58) Field of Search ..... 347/85–87

(56) References Cited

U.S. PATENT DOCUMENTS

| | | | |
|---|---|---|---|
| 3,950,761 | 4/1976 | Kashio . | |
| 4,558,326 | 12/1985 | Kimura et al. . | |
| 5,252,933 | 10/1993 | Tomii et al. . | |
| 5,409,134 | 4/1995 | Cowger et al. . | |
| 5,450,112 | 9/1995 | Scheffelin . | |
| 5,537,134 | 7/1996 | Baldwin et al. . | |
| 5,784,087 | 7/1998 | Wallace et al. . | |
| 5,854,646 * | 12/1998 | Barinaga et al. | 347/85 |

FOREIGN PATENT DOCUMENTS

| | | |
|---|---|---|
| 0375383A1 | 6/1990 | (EP) . |
| 0741038A2 | 11/1996 | (EP) . |
| 0778145A1 | 6/1997 | (EP) . |

* cited by examiner

*Primary Examiner*—Judy Nguyen
(74) *Attorney, Agent, or Firm*—Kevin B. Sullivan

(57) ABSTRACT

The present invention relates to an ink supply of the type having a diaphragm pump that is actuated by an actuator for providing ink to a printhead. The diaphragm pump includes a diaphragm and a chassis. The diaphragm has an integral pressure plate portion formed therein. The chassis and the diaphragm define a variable volume chamber. The chassis has a bias portion disposed therein for engaging the integral pressure plate portion to urge the pressure plate in a direction away from the chassis. The pressure plate urges the diaphragm away from the chassis to expand the variable volume chamber.

6 Claims, 10 Drawing Sheets

SECTION B-B'

DIAPHRAGM PUMP HAVING AN INTEGRAL PRESSURE PLATE

CROSS REFERENCE TO RELATED APPLICATIONS

This is a divisional of copending application Ser. No. 09/012,384 filed on Jan. 23, 1998.

BACKGROUND OF THE INVENTION

The present invention relates to an ink supply for an ink-jet printer having a diaphragm pump providing ink from the ink supply to a printhead. More particularly, the present invention relates to a method and apparatus for forming a highly reliable diaphragm pump capable of running repeated cycles without failure.

The use of an ink supply that is separately replaceable from the printhead is disclosed in patent application Ser. No. 08/429,915, entitled "Ink Supply For An Ink-Jet Printer" assigned to the assignee of the present invention. The advantage of this type of ink supply is that it allows the user to replace the ink container without replacing the printhead. The printhead can then be replaced at or near the end of printhead life and not when the ink container is exhausted.

Ser. No. 08/429,915 discloses the use of an ink container that includes a diaphragm pump. The diaphragm pump is actuated by an actuator associated with the ink-jet printer for supplying ink from the ink container to the printhead. The use of a pump associated with the ink container ensures a reliable supply of ink to the ink-jet printhead. An interruption in ink flow to the printhead can result in a reduction in print quality or damage to the printhead. This interruption in the flow of ink to the printhead during operation of the printhead can result in printhead deprime which can result in excessive heating of the printhead. If this printhead heating is severe enough the printhead reliability can be reduced or the printhead can fail. Therefore, it is important that the apparatus used to provide ink from the ink container to the printhead be highly reliable.

The diaphragm pump as disclosed in Ser. No. 08/429,915 includes a chassis and a diaphragm attached to the chassis. Engagement of the diaphragm by an actuator varies the volume of the chamber defined by the chassis and diaphragm. Varying the volume of the chamber allows ink to be drawn into the chamber and expelled from the chamber. Ink is drawn into the chamber from an ink reservoir. Ink expelled from the chamber is transferred to the printhead by way of an ink conduit.

patent application Ser. No. 08/846,785, entitled "Diaphragm Pump For Ink Supply", assigned to the assignee of the present invention, discloses the use of an ink container diaphragm pump that makes use of a two-layer diaphragm. The two-layer diaphragm includes a vapor barrier layer for limiting the diffusion of air through the diaphragm into the chamber. A second layer of the diaphragm is an elastomer layer disposed between the chassis and the vapor barrier layer. The elastomer layer limits passage of liquid within the chamber through the diaphragm. The two-layer diaphragm is fastened to a chassis using a crimp cap.

It is important that the diaphragm pump be highly reliable. The diaphragm pump should be capable of operating over a large number of actuation cycles without producing fatigue failures in the diaphragm that may result in ink leakage. In addition, the diaphragm should be strong and resistant to rupturing if the ink container is dropped.

The diaphragm on the diaphragm pump should be flexible so that the force required to activate the pump is relatively low. The use of a lower activation force diaphragm pump allows the use of actuators that have lower output force capability. These lower output force actuators tend to be lower cost than actuators having higher output force requirements, reducing the cost of the printing system. In addition, the use of lower force actuators tends to reduce the cost of a retention system used to secure the ink container to the printer. The use of lower cost retention systems tends to reduce the cost of the printing system.

The diaphragm should also be a good barrier for both liquid and gas. It is important that the diaphragm prevent water within the ink from evaporating through the diaphragm altering the viscosity of the ink. In addition, it is important that air be prevented from permeating through the diaphragm producing air bubbles inside the chamber. These air bubbles tend to reduce the pump efficiency as well as introduce air bubbles to the printhead. Air bubbles once in the printhead may enter an ink ejection chamber reducing the volume of ink in the ejection chamber. If sufficient displacement of ink occurs print quality can be reduced as well as a reduction in printhead cooling can occur. This reduction in cooling can result in overheating of the resistive heating element that if severe enough can result in a catastrophic failure of the heating element.

Finally, the diaphragm pump should provide a consistent discharge volume. This discharge volume should have little variation from ink container to ink container. In addition, the diaphragm pump should be well suited for high volume manufacturing techniques allowing the ink container to be produced at lower cost.

SUMMARY OF THE INVENTION

The present invention relates to an ink supply of the type having a diaphragm pump that is actuated by an actuator for providing ink to a printhead. The diaphragm pump includes a diaphragm and a chassis. The diaphragm has an integral pressure plate portion formed therein. The chassis and the diaphragm define a variable volume chamber. The chassis has a bias portion disposed therein for engaging the integral pressure plate portion to urge the pressure plate in a direction away from the chassis. The pressure plate urges the diaphragm away from the chassis to expand the variable volume chamber.

Another aspect of the present invention is a crimp cap for securing a diaphragm to a chassis associated with an ink container. The crimp cap includes a base portion and a pair of upright sides extending upward and outward away from the base portion. Each of the pair of upright sides have an engagement portion disposed toward an end of the upright side opposite the base portion. With the crimp cap positioned with the diaphragm between the base portion and the chassis the engagement portion disposed on each of the pair of upright sides is positioned to engage a flange on the chassis when the pair of upright sides are urged toward the chassis so that the engagement portion engages the flange fixing the diaphragm to the chassis.

DETAILED DESCRIPTION OF THE PREFERRED EMBODIMENT

Figure 1:
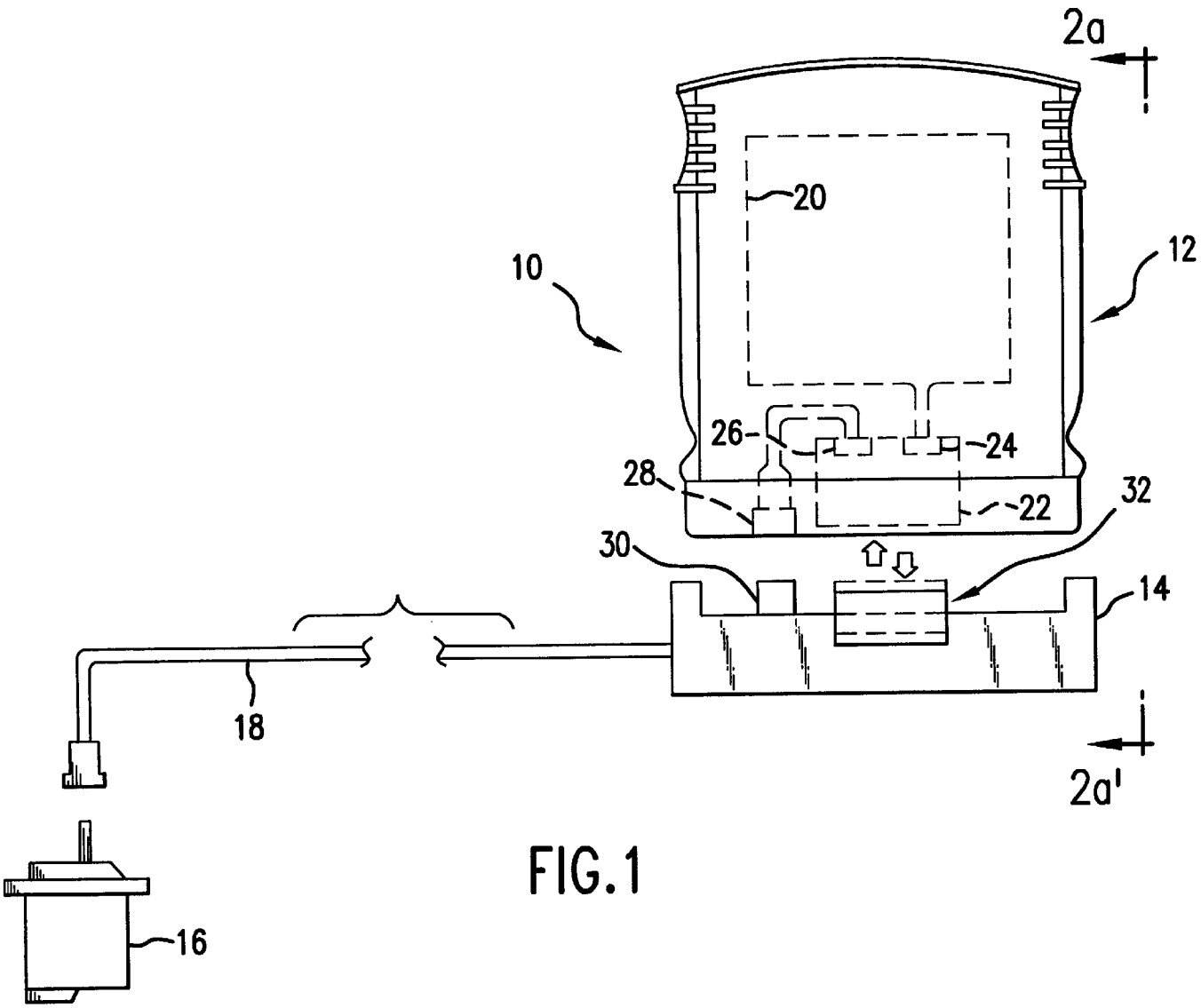
FIG. 1 depicts a schematic representation of an ink container having a diaphragm pump of the present invention for providing ink to an ink-jet printhead.

FIG. 1 depicts an ink-jet printing system 10 that includes an ink container 12 that contains a diaphragm pump of the present invention. The printing system 10 also includes a supply station 14 for receiving the ink container 12. The supply station 14 is fluidly connected to a printhead 16 by a conduit 18.

The ink container 12 includes an ink reservoir 20, a diaphragm pump portion 22 and an inlet 24 for selectively allowing fluid to pass from the ink reservoir 20 to the diaphragm pump portion 22. Also included in the ink container 12 is an ink outlet 26 for selectively allowing fluid to pass from the diaphragm pump portion 22 to a fluid outlet 28.

The supply station 14 includes a fluid inlet 30 and an actuator 32. With the ink container 12 properly positioned in the supply station 14 the fluid outlet 28 associated with the ink container fluidicly connects with the fluid inlet 30 associated with the supply station 14. In addition, proper positioning of the ink container 12 in the supply station 14 allows the actuator 32 to engage the diaphragm pump portion 22. This engagement between the actuator 32 and the diaphragm pump portion 22 produces the passage of fluid from the ink reservoir 20 to the printhead 16. The diaphragm pump portion 22 and actuator 32 ensure a constant supply of ink is provided to the printhead 16.

Figure 2B:
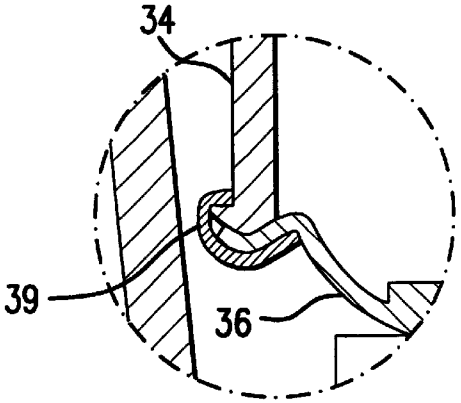
FIG. 2*b* is a greatly enlarged cross section view of the area of the diaphragm pump circled in FIG. 2*a*.
Figure 2A:
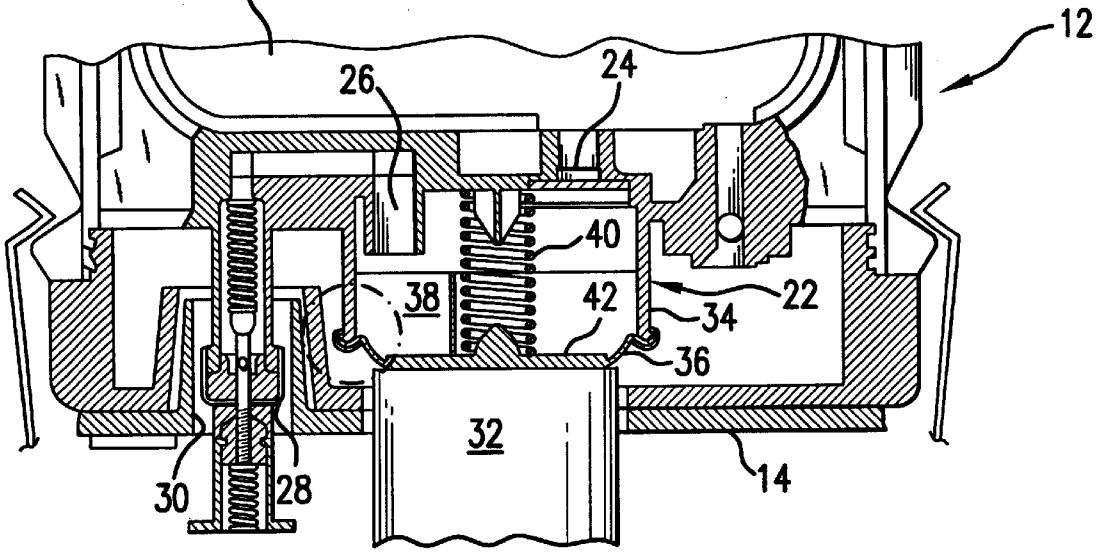
FIG. 2*a* depicts a cross-section, shown partially broken away, taken across lines 2*a*–2*a*' of the ink container of FIG. 1 shown with an actuator positioned for activating the diaphragm pump.

FIG. 2*a* depicts a sectional view of the ink container 12 mounted to the supply station 14 shown in FIG. 1. The ink container 12 includes the ink reservoir 20 that is in fluid communication with the diaphragm pump portion 22 by an inlet 24. Ink is selectively provided to the diaphragm pump portion 22 through the inlet 24. In one preferred embodiment the inlet 24 acts as a check valve for allowing ink to pass from the ink reservoir 20 to the diaphragm pump portion 22 and for limiting ink passage from the diaphragm pump portion 22 to the ink reservoir 20. The diaphragm pump portion 22 expels ink through the outlet 26. Ink expelled from the diaphragm pump portion 22 is then provided to the printhead 16 via the supply station 14 and the conduit 18. In one preferred embodiment the outlet 26 allows ink to pass from the diaphragm pump portion 22 to the printhead 16 and limits ink passage into the pump portion 22 from either the printhead 16, supply station 14 or conduit 18. Ink flow back into the diaphragm is limited by a check valve disposed at the printhead 16, the flow resistance within the conduit 18, and a negative back pressure of the printhead 16 are used to limit ink from returning to the diaphragm pump portion 22 through outlet 26.

With the ink container 12 properly positioned in the supply station 14 the fluid inlet 30 associated with the supply station engages the fluid outlet 28 associated with the ink container 12 to form a fluid interconnection between the ink container 12 and the supply station 14.

The diaphragm pump portion 22 in the preferred embodiment includes a chassis 34 and a diaphragm 36 that define a variable volume chamber 38. As seen in FIG. 2*b*, the diaphragm 36 in the preferred embodiment is attached to the chassis 34 using a fastening device 39 such as a crimp cap as will be discussed in more detail later. Within the chamber 38 is a biasing means 40 for biasing the diaphragm 36 towards the actuator 32. In the preferred embodiment, the biasing means 40 is a spring that biases a pressure plate portion 42 that is formed integrally with the diaphragm 36.

The actuator 32 engages the diaphragm 36 and displaces the diaphragm 36 toward the chamber 38 compressing the spring 40. As the diaphragm 36 is displaced toward the chamber 38 the volume of the chamber 38 is reduced. This reduction in volume of chamber 38 pressurizes the ink within the chamber 38 causing ink to pass through outlet 26 towards the printhead 16. As the actuator 32 is removed the spring 40 relaxes, displacing the diaphragm 36 away from the chamber 38, increasing the chamber 38 volume, and reducing the chamber pressure, allowing ink to flow from the ink reservoir 20 into the chamber 38 through the inlet 24. In the preferred embodiment the inlet 24 is a check valve allowing ink to flow only from the ink reservoir 20 to the chamber 38 and limits ink flow from the chamber 38 to the ink reservoir 20. Therefore, as the diaphragm 36 is displaced toward the chamber 38 the inlet 24 prevents ink passage from the chamber 38 to the ink reservoir 20.

Figure 3:
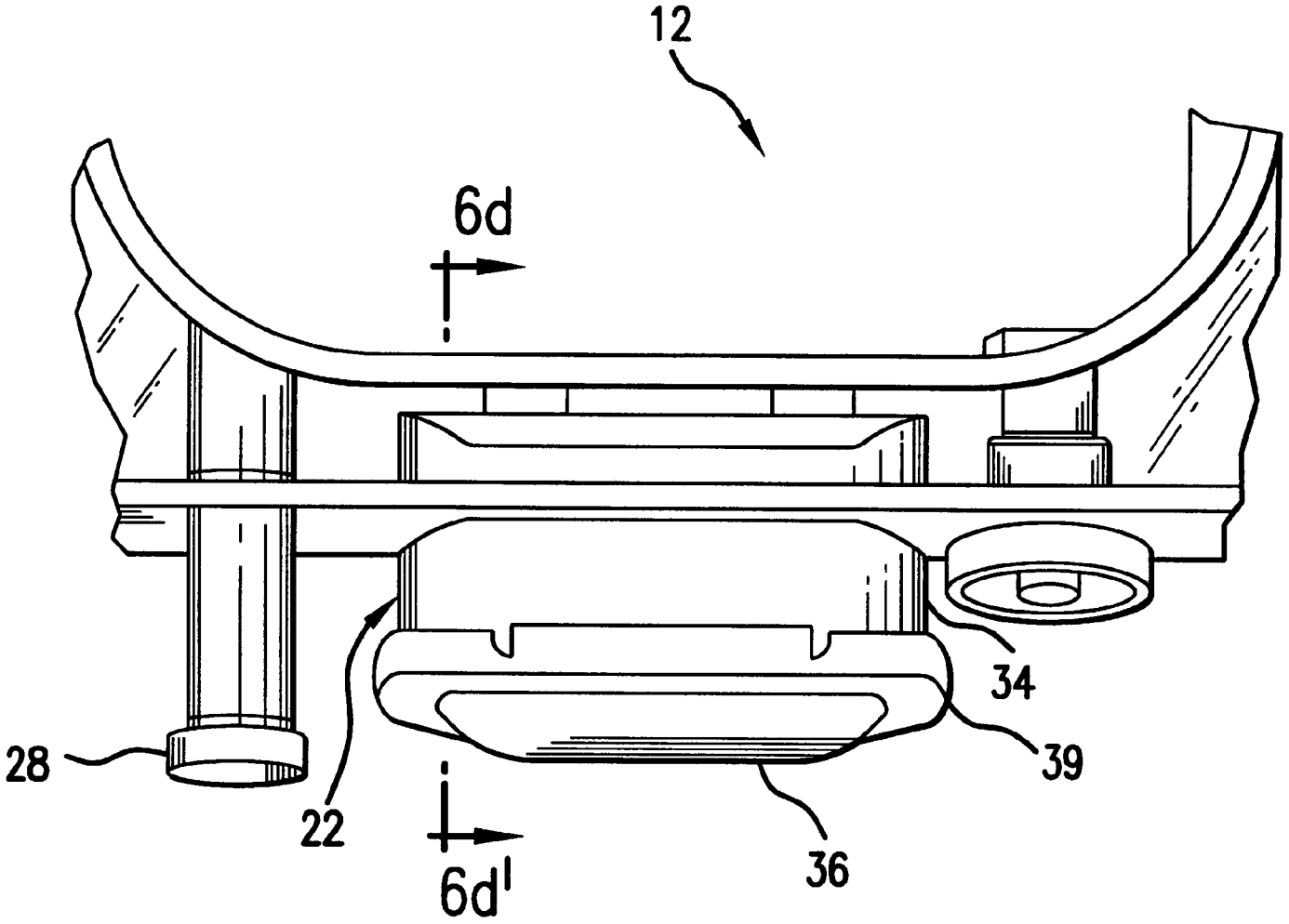
FIG. 3 represents a perspective view of the diaphragm pump of FIG. 2*a*.

FIG. 3 is a perspective view of the diaphragm pump portion 22 of the present invention. The diaphragm pump portion 22 is formed integrally with the ink chassis 34. The diaphragm pump portion 22 includes the chassis 34 and the diaphragm 36. The fastening device 39 mechanically holds the diaphragm 36 in compression with the chassis 34 to form a seal between the diaphragm 36 and the chassis 34. Although the preferred embodiment makes use of a crimp cap as the fastening device 39 any other mechanical fastening device for maintaining the diaphragm 36 in compression with the chassis 34 may also be suitable.

Figure 4:
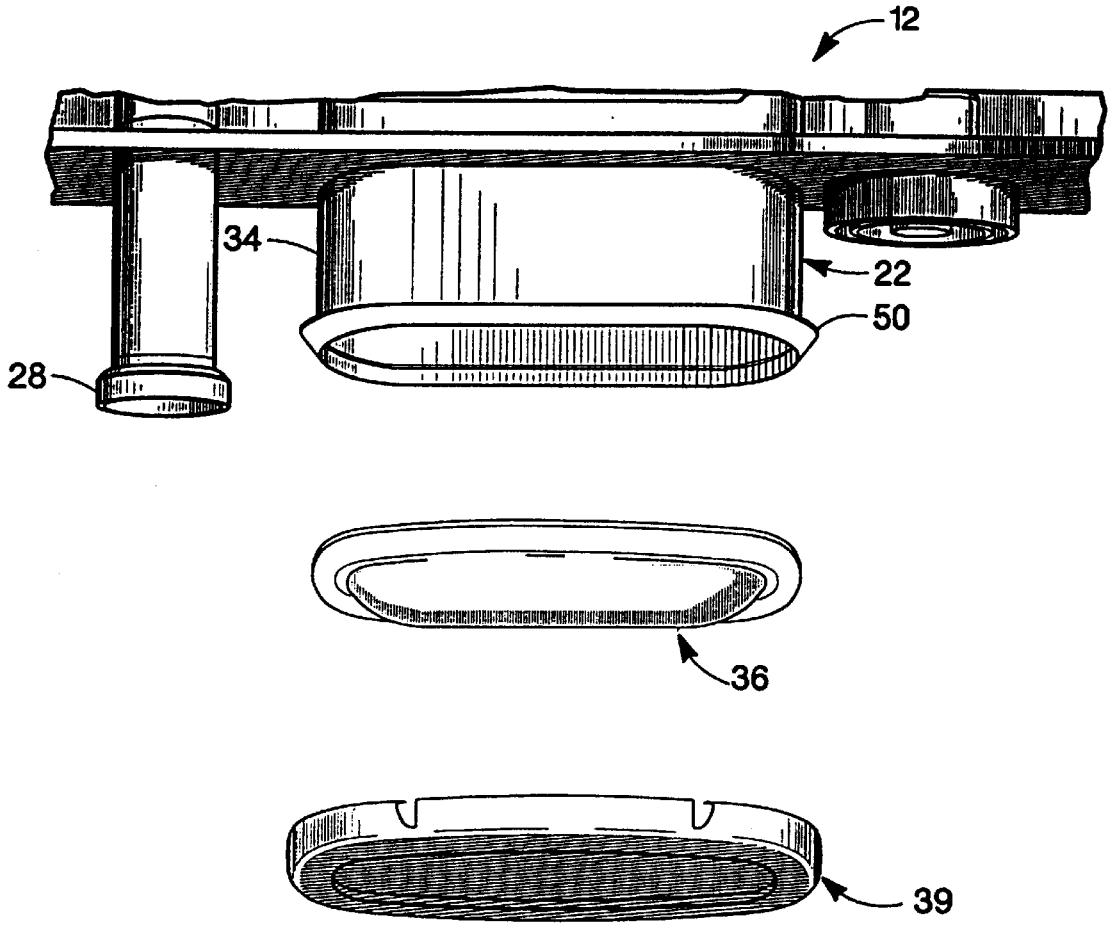
FIG. 4 depicts an exploded view of the diaphragm pump shown in FIG. 2*a*.

FIG. 4 depicts an exploded view of the preferred embodiment of the diaphragm pump portion 22 shown in FIG. 3. The diaphragm 36 is preformed to have an elongate dome shape. The fastening device 39 has a base portion having an opening therein. The fastening device 39 is positioned on the chassis 34 with the diaphragm positioned therebetween such that the elongate dome portion extends at least partially through the hole in the base portion of the fastening device 39. The fastening device 39 is crimped or folded over a flange 50 on the chassis 34 to secure compression seal between the chassis 34 and the diaphragm 36.

Figure 5A:
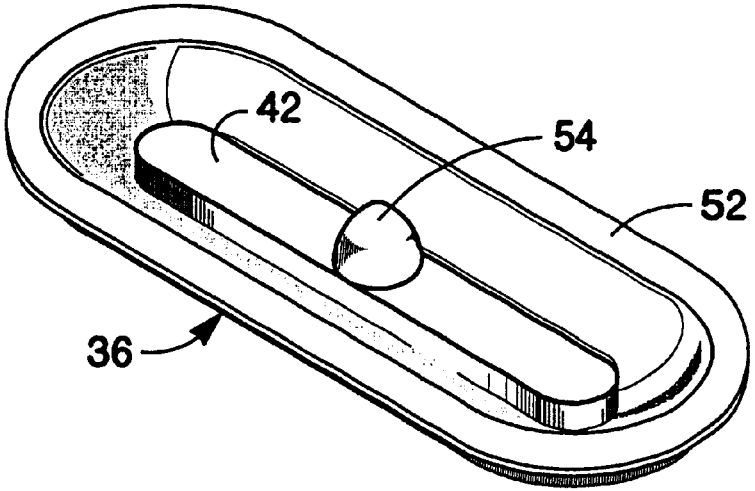
FIG. 5*a* depicts a perspective view of a diaphragm of the present invention having an integral pressure plate.

FIG. 5*a* depicts the preferred diaphragm 36 in perspective as viewed from the chassis 34. The diaphragm 36 includes a sealing surface 52, the pressure plate portion 42 and a spring engagement portion 54 extending upward from the pressure plate portion 42.

In the preferred embodiment, the sealing surface 52, the pressure plate portion 42 and the spring engagement portion 54 are each integral with the diaphragm 36.

In the preferred embodiment the diaphragm 36 is made from a compressible material which can be held in compression by the fastening device 39 so that the sealing surface 52 forms a good fluid seal with the chassis 34. This compressible material should be capable of withstanding large pressure loads without leaking or failing. The diaphragm 36 must be able to withstand large pressure spikes that can occur when the ink container 12 is dropped. In addition the diaphragm 36 should have a high fatigue life capable of operating over a large number of pumping cycles. Finally, the diaphragm 36 should be of a material selected to provide a fluid barrier to fluids within the diaphragm pump portion 22. Aqueous inks that are frequently used in inkjet printing contain water. Therefore, the diaphragm 36 should provide a good barrier to water.

The diaphragm 36 outer surface opposite the chamber 38 is in contact with air. Therefore, the diaphragm 36 should prevent air from permeating through the diaphragm 36 adding to air bubbles inside the chamber 38. Air permeation through the diaphragm 36 increases the probability of bubbles passing to the printhead 16 which can reduce printhead 16 reliability and reduce print quality. In addition, the diaphragm 36 should also provide a barrier to the loss of water vapor from the chamber 38. Therefore, the diaphragm 36 should be formed of a material having a low permeability. In addition the diaphragm 36 should have a high fatigue life capable of operating over a large number of pumping cycles without substantial increase in permeability and should be well suited to mechanical fastening.

In one preferred embodiment the diaphragm 36 is formed from a molded elastomer diaphragm formed of Ethylene-Propylene-Diene Monomer (EPDM). EDPM materials are discussed in more detail in "Science and Technology of Rubber", editors James E. Mark, Burak Ehrman, and F. R. Eirich, Academic Press, London, 1994, p. 34. The diaphragm 36 can be formed in a variety of shapes such as a round or oval domed shape. It is preferred that the diaphragm 36 is thermally formed to have an elongate dome shape. The central portion of the dome has a thickened portion defining the pressure plate 42. The spring engagement feature 54 is formed centrally on the pressure plate 42. In this preferred embodiment the diaphragm 36, pressure plate 42 and engagement portion 54 are molded from the same material. Alternatively, a stiffener such as sheet metal can be insert molded into the diaphragm 36 to stiffen the diaphragm 36 thereby forming a pressure plate 42 within the diaphragm 42.

There is a tradeoff between the permeability of the diaphragm 36 and the stiffness or force required to deform the diaphragm 36. For example, doubling the thickness of the elastomer material used reduces the permeability of this material by one half. However, the increase in thickness of the elastomer material increases the stiffness of the material or force required to actuate the pump. Therefore, the thickness of the material should be selected to minimize the permeability while providing an activation force that is within the range of activation forces of the actuator 32. In the preferred embodiment, the elastomer is a mixture of Bromo Butyl and EPDM material having a nominal hardness of 67 shore A. durometer.

Figure 5B:
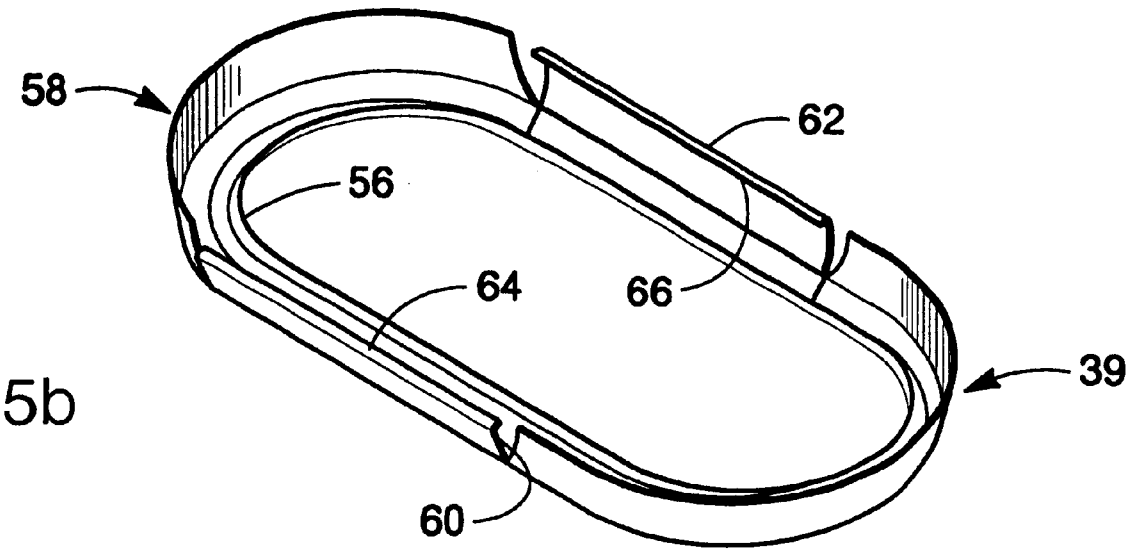
FIG. 5*b* depicts a perspective view of a fastening device of the present invention for fastening the diaphragm of FIG. 5*a* to a pump chassis.

FIG. 5*b* depicts a preferred embodiment of the fastening device 39 of the present invention for fastening the diaphragm 36 to the chassis 34. The fastening device 39 includes a base portion 56 and upright sides 58 extending generally upward from the base portion 56. The base portion 56 is elongated along an axis of elongation. The upright sides 60 and 62 on either side of the axis of elongation are gull winged, extending upward and outward away from the base portion 56. Each of the gull winged upright sides 60 and 62 include an engagement portion 64 and 66, respectively, disposed toward an end of the upright sides, opposite the base portion 56. As will be discussed next with respect to FIGS. 6*a*–6*d* the use of gull winged upright sides 60 and 62 having engagement portion 64 and 66 allows the upright sides to be compressed together for reliably attaching the diaphragm 36 to the chassis 34.

Figure 6A:
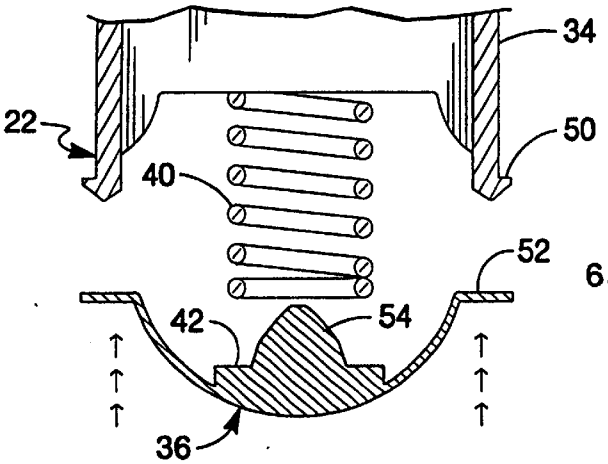
FIGS. 6*a*, 6*b*, and 6*c* depict a sequence of sectional views illustrating the fastening of the diaphragm to a chassis using a crimp cap of the present invention.
Figure 6C:
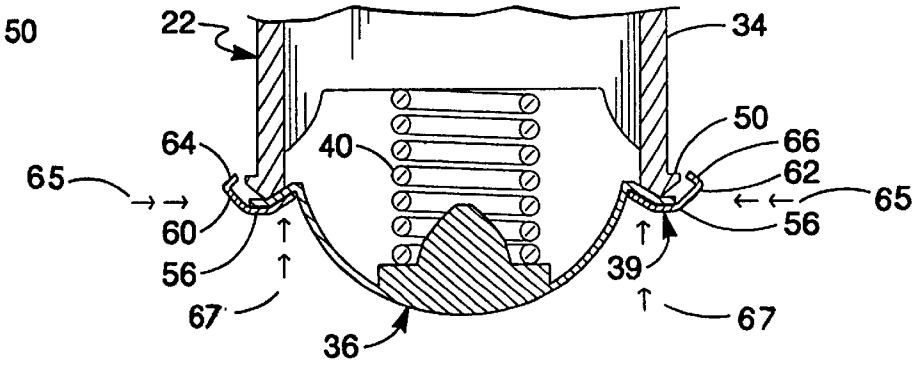
Figure 6B:
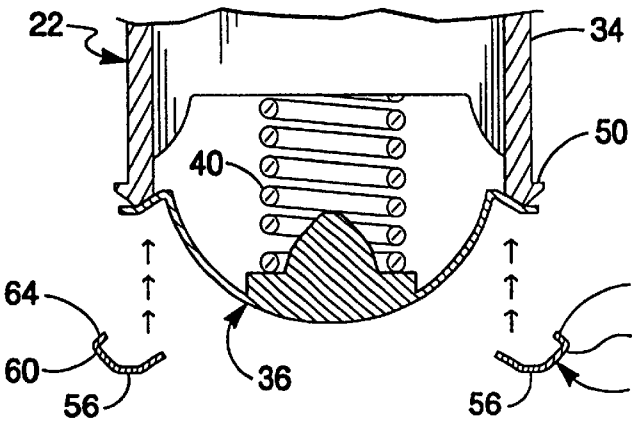
Figure 6D:
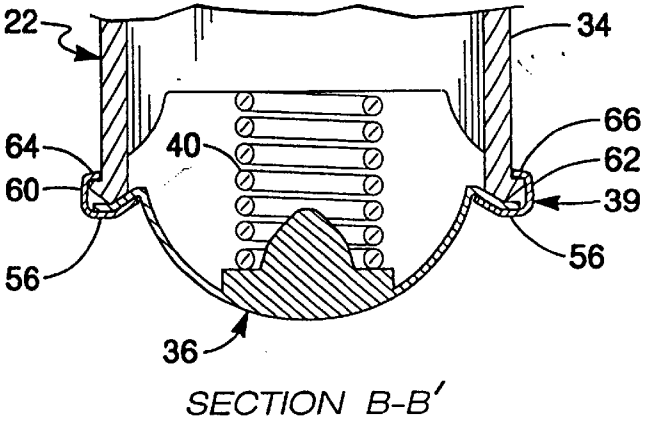
FIG. 6*d* is a section view taken across line 6*d*–6*d*' of FIG. 3 illustrating the completion of the sequence shown in FIGS. 6*a*–6*c* with the diaphragm fastened to the chassis using the crimp cap of the present invention.

FIGS. 6*a*–6*d* are sectional views showing an assembly sequence illustrating the preferred method for attaching the diaphragm 36 to the chassis 34. The diaphragm 36 is positioned on the chassis 34 such that the sealing surface 52 associated with the diaphragm 36 engages a corresponding sealing surface associated with the chassis 34 as shown in FIGS. 6*a* and 6*b*. In addition, the spring engagement portion 54 is aligned to engage the spring 40 associated with the chassis 34 to maintain the spring 40 in engagement with the pressure plate 42. The remaining upright sides 58 associated with the fastening device 39 are crimped in a manner similar to that discussed in patent application Ser. No. 08/846,785 and therefore will not be discussed here.

FIGS. 6*a*, 6*b*, and 6*c* depict the step of positioning the fastening device 39 proximate the chassis 34 such that the engagement portions 64 and 66 are aligned with the flange 50 associated with the chassis 34. Illustrated using arrows 65 in FIGS. 6*c* opposing forces are applied to each of the upright sides 60 and 62 to urge these upright sides inwardly towards the chassis 34. Coincident with the opposing forces represented by arrows 65 a counteracting force represented by arrows 67 is applied to capture a countersink portion of the fastening device 39. As the upright sides 60 and 62 are urged inwardly towards the chassis corresponding engagement portions 64 and 66 engage the flange 50 associated with the chassis 34 to secure the diaphragm 36 to the chassis 34. The counteracting forces prevent improper deformation of the fastening device 39 as well as prevent borrowing of the chassis 34. With the diaphragm 36 secured to the chassis 34 a fluidic seal is formed between the diaphragm 36 and the chassis 34 (see FIG. 6*d*). In the preferred embodiment, the diaphragm 36 is in compression against the chassis 34 to form a reliable compression seal. embodiment, the diaphragm 36 is in compression against the chassis 34 to form a reliable compression seal.

The use of preformed upright gull-wings 60 and 62 simplifies the attachment of the fastening device 39 to the chassis 34. Without the use of the preformed gull-winged upright sides the application of a force to fold the upright sides 58 over the flange 50 tends to result in buckling of the upright sides 58 along the longitudinal axis of the chassis 34. The use of preformed gull-winged upright sides 60 and 62 improves the reliability of the attachment of the fastening device 39 to the chassis 34 by not requiring folding of upright sides 58 along the longitudinal axis. Instead, the preformed upright sides 60 and 62 are positioned along the longitudinal axis. The preformed gull-winged upright sides 60 and 62 requires only an inward force 65 and a counter-acting force 67 and does not require folding. This inward force tends to not result in buckling of the upright sides 58 or the chassis 34.

Figure 7A:
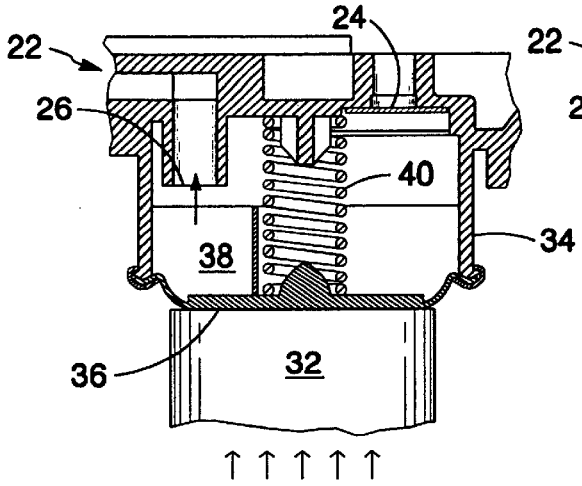
FIGS. 7*a*, 7*b*, 7*c*, 7*d*, and 7*e* depict a sequence of cross-section views as shown in FIG. 2*a* illustrating operation of the diaphragm pump of the present invention.
Figure 7D:
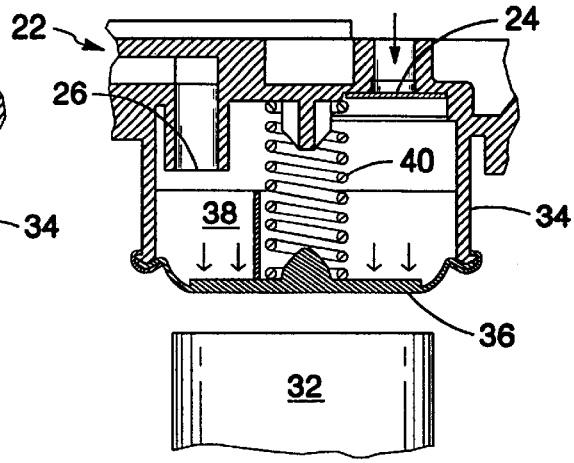
Figure 7B:
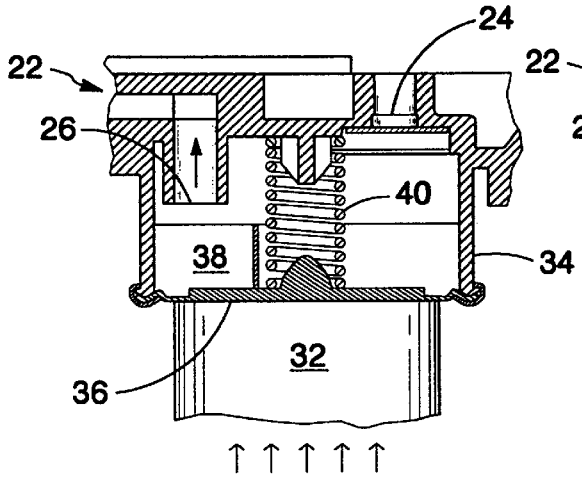
Figure 7E:
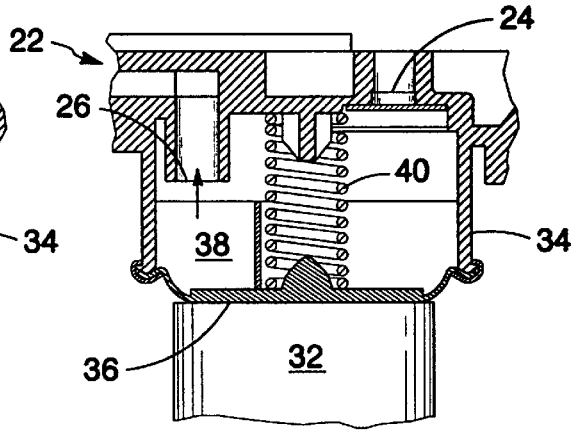
Figure 7C:
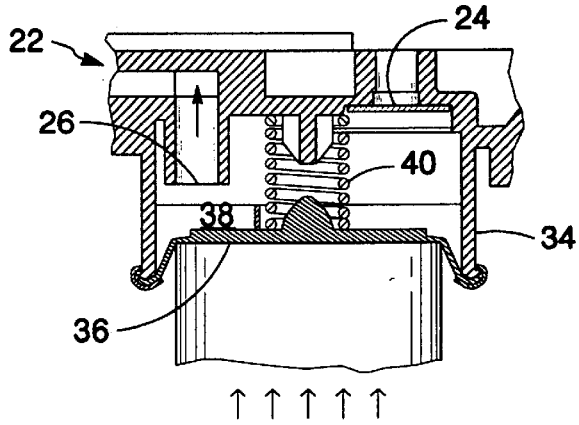

FIGS. 7*a*–7*e* depict the operation of the diaphragm pump of the present invention. FIG. 7*a* depicts the beginning of the pump cycle wherein the actuator 32 engages the diaphragm 36 to provide fluid pressure in the chamber 38. The inlet valve 24 is closed preventing fluid flow from the chamber 38 into the reservoir 20 thereby providing fluid flow from the fluid outlet 26. As ink is ejected from the printhead 16 the diaphragm 36 is urged inward to displace ink from the chamber 38 and out from fluid outlet 26 and into printhead 16 to replace the ejected ink as shown in FIGS. 7*b* and 7*c*.

FIGS. 7*d* and 7*e* depicts a refresh cycle wherein the actuator 32 is removed from the engagement with the diaphragm 36. The removal of the actuator 32 from the diaphragm 36 allows the biasing means 40 to expand pushing the diaphragm 36 toward the actuator 32. As the diaphragm moves outwards towards the actuator 32 the volume of the chamber 38 increases drawing fluid from the ink reservoir 20 through check valve 24 to replenish the chamber 38. A check valve disposed in the printhead 16 prevents fluid from the printhead or conduit 18 from replenishing the chamber 38.

Figure 8:
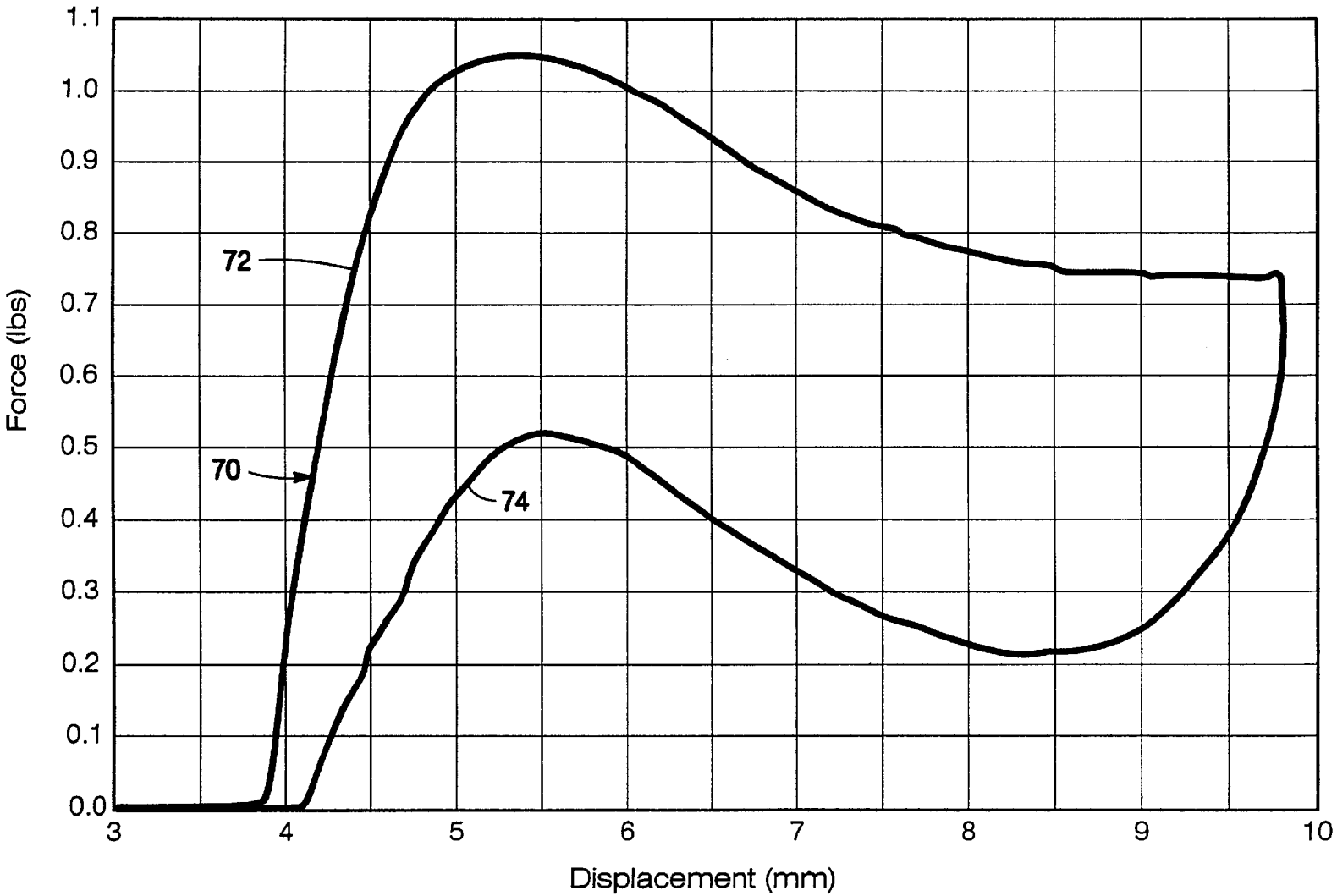
FIG. 8 and FIG. 9 depict actuation force vs. displacement curves for undesirable diaphragms.
Figure 9:
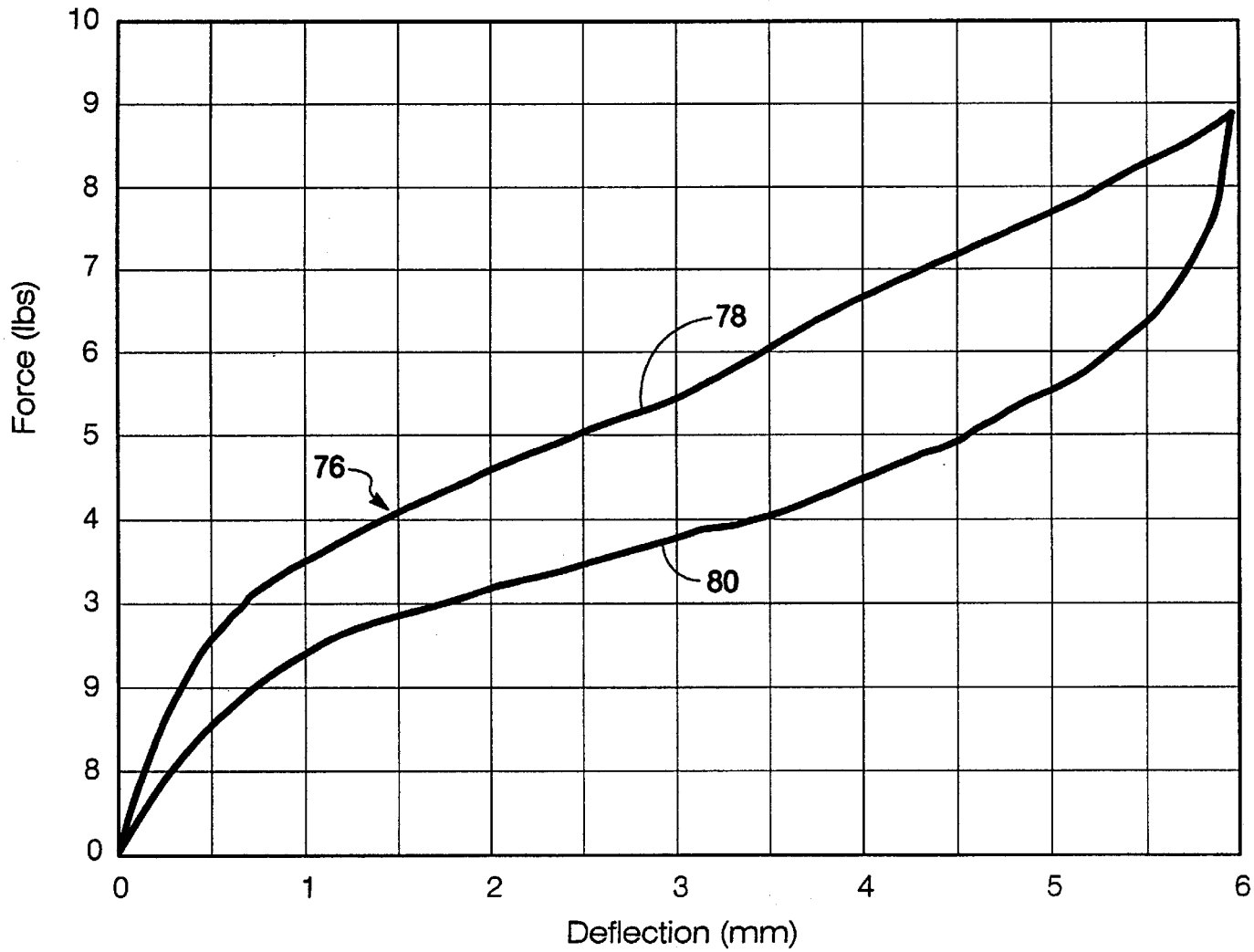
Figure 10:
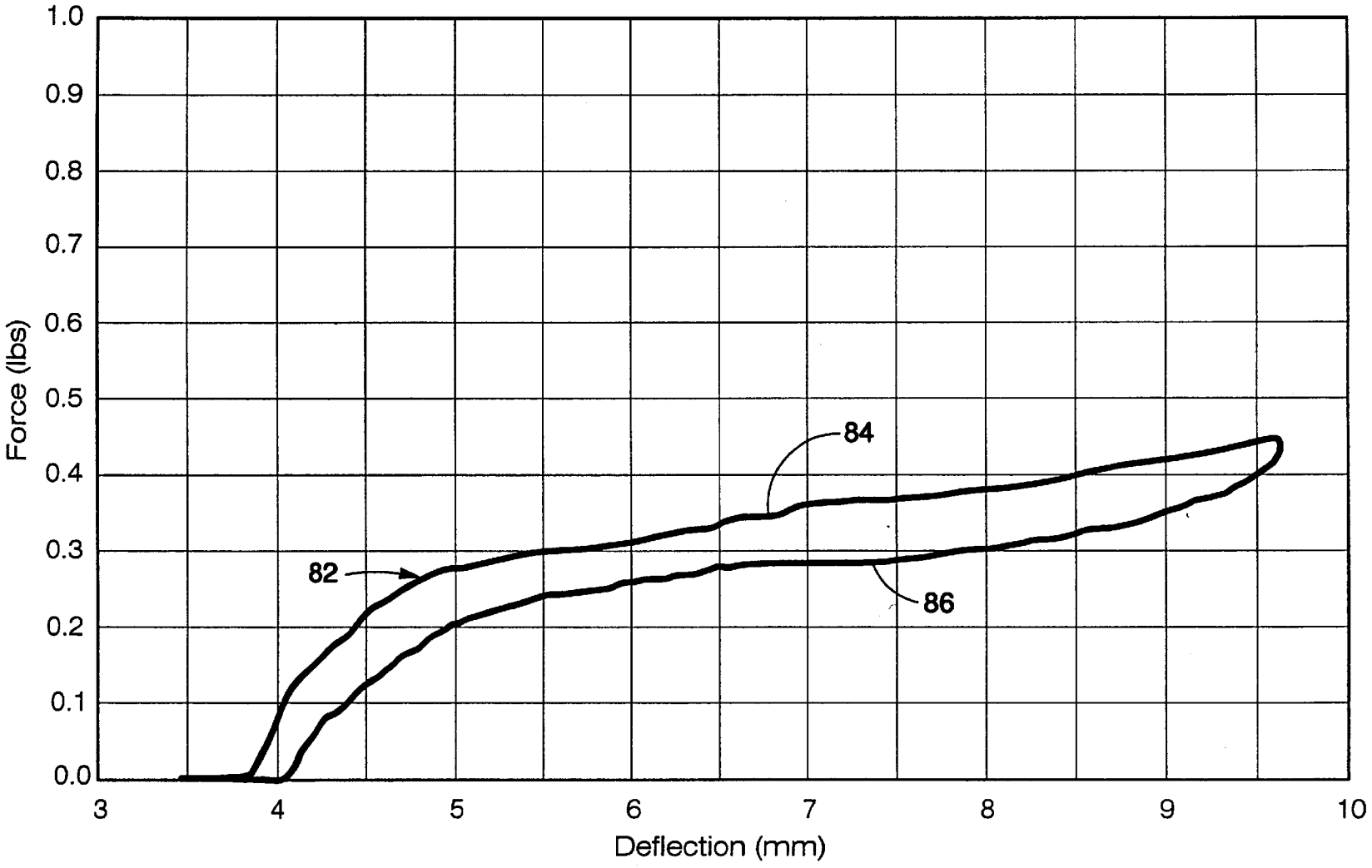
FIG. 10 depicts an actuation force versus displacement curve for the preferred diaphragm of the present invention.

FIGS. 8, 9, and 10 represent actuation force versus deflection curves for several different diaphragm materials. It is important that the diaphragm 36 exhibit a relatively low actuation force so that the force required for retaining the ink container 12 in the supply station 14 is relatively small. It is preferable that the nominal actuation force be less than 0.8 pounds. In the preferred embodiment the nominal actuation force is less than 0.5 pounds. In addition, it is important that the diaphragm have a return force that is high enough to generate enough backpressure in the chamber 38 during the refresh cycle to rapidly refill the chamber 38 with ink. Finally, it is important that similar force vs. displacement curves be exhibited for both actuation and refresh cycles.

FIG. 8 depicts a nominal actuation force versus displacement curve 70 for one undesirable diaphragm material. This curve illustrates relatively large hysterisis between the actuator 32 depressing the diaphragm 36 represented by curve portion 72 and the spring 40 urging the diaphragm 36 back once the actuator 32 is released represented by curve portion 74. It can be seen from this curve 70 that the force required for depressing the diaphragm is relatively large, on the order of 1.0 pound. In addition, diaphragm 36 return force is relatively low indicating that the diaphragm 36 buckling force is large relative to the spring return force. It is important that the diaphragm 36 have sufficient stiffness to recover relatively quickly thereby generating sufficient suction force to draw ink into the ink chamber 38 through the check valve 24 as shown in FIGS. 7*a*–7*e*.

FIG. 9 represents a nominal actuation force versus deflection curve 76 for a diaphragm 36 that is formed using an outer film material that acts as a barrier layer. The actuator 32 depressing the diaphragm 36 is represented by curve portion 78 and spring 40 urging the diaphragm 36 back is represented by curve portion 80. It can be seen from this curve 76 that the slope of the curve is too steep indicating that the actuator force is too high.

FIG. 10 represents a nominal activation force versus deflection curve 82 for the diaphragm 36 of the present invention. The actuation of the diaphragm 36 by the actuator 32 is represented by curve portion 84 and the return of the diaphragm 36 by spring 40 is represented by curve portion 86. It can be seen from FIG. 10 that the activation force is less than 0.5 pounds which is significantly less than the activation force for the diaphragm material shown in FIGS. 8 and 9. The low actuation force is accomplished by designing the flexing portion of the diaphragm 36 to be relatively thin and using a diaphragm material of high resilience. The use of a relatively thin flexing portion of high resilience allows the spring 40 to overcome unbuckling forces in the flexing portion, allowing the return force versus displacement curve to more precisely match the actuation force curve. The diaphragm material of the present invention is selected such that the curve 82 has a high initial and final slope and a low middle slope. Once sufficient activation force is applied, the diaphragm 36 tends to buckle over or roll in thereby reducing the activation force required producing a relatively low slope portion of the curve. As discussed previously, it is important that the activation force be relatively low to reduce the requirements of the actuator 32 thereby reducing the cost of the printing system. Another advantage of the present invention is the use of a thickened pressure plate portion 42 that assures that the diaphragm 36 returns completely in a predictable manner.

The diaphragm pump 22 of the present invention provides a pump that is capable of operating for a repeated pump cycles without fatigue failures. In addition, the pump 22 of the present invention is more resistant to leaking and rupture of the diaphragm during drop testing. Finally, the diaphragm pump 22 of the present invention is well suited to a high-volume manufacturing environment allowing the diaphragm to be attached quickly to the pump chassis forming a highly reliable seal. In addition, the use of a crimp cap type fastening device 39 allows the diaphragm crimp force to be highly controlled thereby forming a uniform seal between the diaphragm 36 and the chassis 34.

What is claimed is:

1. A fastening device for securing a diaphragm to a chassis associated with an ink container, the diaphragm and the chassis defining a variable volume chamber for delivering pressurized ink from the ink container, the fastening device comprising:

a base portion elongated along an axis of elongation;

an upright circumferential wall surrounding the base portion, the upright circumferential wall having a plurality of breaks that define a pair of upright sides on either side of the axis of elongation, each upright side of the pair of upright sides extending upward and outward away from the base portion so as to form an obtuse angle relative to the base portion, each upright side of the pair of upright sides having an engagement portion disposed toward an end of the upright side opposite the base portion; and wherein with the fastening device positioned on the chassis with the diaphragm between the base portion and the chassis, the engagement portion disposed on each upright side of the pair of upright sides is positioned to engage a flange on the chassis when the pair of upright sides are urged toward the chassis so that the engagement portion engages the flange fixing the diaphragm to the chassis.

2. The fastening device of claim 1 wherein the base portion defines an opening for allowing an actuator to engage the diaphragm for changing a volume associated with the variable volume chamber.

3. The fastening device of claim 1 wherein the engagement portion of each upright side of the pair of upright sides is defined by a pre-bent portion of the upright side, the pre-bent portion engaging the flange on the chassis without deformation of the pre-bent portion.

4. The fastening device of claim 1 wherein portions of the upright circumferential wall other than the pair of upright sides are perpendicular to the base portion.

5. A method for forming an ink container diaphragm pump, the method comprising:

positioning a diaphragm and a crimp cap on a chassis having a variable volume chamber, the chassis having a flange disposed proximate a chassis opening and the crimp cap having a base portion elongated along an axis of elongation and an upright circumferential wall, the upright circumferential wall having a plurality of breaks that define a pair of upright sides on either side of the axis of elongation, each upright side of the pair of upright sides extending upward and outward away from the base portion so as to form an obtuse angle relative to the base portion, each upright side of the pair of upright sides having an engagement portion disposed toward an end of the upright side opposite the base portion; and urging the upright sides inwardly toward the chassis so that each engagement portion engages the flange so that the base portion secures the diaphragm to the chassis.

6. The method of claim 5 wherein the engagement portion of each upright side of the pair of upright sides is defined by a pre-bent portion of the upright side, and wherein the step of urging the upright sides inwardly toward the chassis includes:

deforming the upright sides inwardly toward the chassis at intersections of the upright sides with the base portion so that each pre-bent portion engages the flange on the chassis without deformation of the pre-bent portion.

* * * * *